United States Patent [19]

Sawhney et al.

[11] Patent Number: 4,976,096

[45] Date of Patent: Dec. 11, 1990

[54] SYSTEM FOR PRODUCING CORE/WRAP YARN

[75] Inventors: A. Paul S. Sawhney, Metairie; Craig L. Folk; Kearny Q. Robert, both of New Orleans, all of La.

[73] Assignee: The United States of America as represented by the Secretary of Agriculture, Washington, D.C.

[21] Appl. No.: 366,702

[22] Filed: Jun. 15, 1989

[51] Int. Cl.[5] ..... D02G 3/36; D01H 5/26; D01H 13/02; D01H 13/04

[52] U.S. Cl. ..... 57/12; 19/244; 19/288; 57/6; 57/210; 57/315

[58] Field of Search ..... 57/3, 5, 6, 12, 315, 57/210; 19/288–292, 258, 244

[56] References Cited

U.S. PATENT DOCUMENTS

| | | | |
|---|---|---|---|
| 2,859,583 | 11/1958 | Parker | 57/12 |
| 2,990,673 | 7/1961 | Adkins, Jr. | 57/12 |
| 3,090,081 | 5/1963 | Klein | 19/248 X |
| 3,255,579 | 6/1966 | Price | 57/315 X |
| 3,350,867 | 11/1967 | Morrison et al. | 57/12 |
| 3,370,410 | 2/1968 | McKeu et al. | 57/12 |
| 3,778,988 | 12/1973 | White et al. | 57/12 |
| 4,070,818 | 1/1978 | Hamel | 57/12 |
| 4,368,611 | 1/1983 | Mainka et al. | 57/6 |
| 4,519,195 | 5/1985 | Belin et al. | 57/3 |
| 4,584,830 | 4/1986 | Fauke et al. | 57/328 |

*Primary Examiner*—John Petrakes

*Attorney, Agent, or Firm*—M. Howard Silverstein; John J. Fado

[57] ABSTRACT

A core wrap system is provided in which a core strand and wrap strands spaced from said core strand on each side of said core strand are passed from the nip of a pair of rollers to a stationary support surface that is outwardly, downwardly curved, and which includes an open channel therein which is outwardly, downwardly curved along the surface; wherein the core strand is passed through the channel from the nip; wherein the wrap rovings are passed from the nip to converge upon and wrap around the core strand in the channel to form wrapped yarn in the channel; and wherein wrapped yarn then is passed through a ring traveler to a wind-up spindle.

20 Claims, 3 Drawing Sheets

SYSTEM FOR PRODUCING CORE/WRAP YARN

FIELD

This invention relates to production of textile yarns.

PRIOR ART

It is known that core/wrap or wrapped core yarns may be produced by wrapping a fibrous sheath around a continuous filament core. Alternatively, a continuous filament may be wrapped around a staple fiber core. Still further, both the core and wrapping or sheathing may consist of staple fibrous materials, or both may be continuous filament materials. To date, in the production of ring-spun core/wrap yarn with staple fibrous materials, the wrapping step has been carried out prior to ring spinning, i.e., during the formation of roving from sliver, thereby producing a core-wrap roving, which subsequently must be spun into yarn in a ring spinning step; or during the drawing process, thereby producing a concentrically cored sliver, which subsequently must be roved into roving and spun into yarn in a ring spinning step. To date, no practical system has been developed to directly produce core/wrap yarn in a ring-spinning frame from a plurality of unwrapped roving strands.

The following definitions apply to several terms that appear in the specification and claims:

Carding—the use of a carding machine to align, clean, and straighten fibers, and to remove very short fibers as well as fine trash, to produce sliver.

Drawing—the making parallel and straightening of sliver fibers to improve the uniformity of linear density, usually accomplished in 1, 2, or 3 passages through drawing equipment known as a draw frame or drafting frame. In each passage through a draw frame, several sliver strands are combined into a single sliver strand.

Drafting—the process whereby a fiber bundle such as a sliver or roving is extended in length in order to reduce the linear density of the bundle and to increase the parallelization of the fibers. Various forms of drafting are employed in carding, drawing, roving, and ring-spinning.

Sliver—the product produced by carding or drawing, i.e., a very coarse strand of fibers having essentially no twist.

Roving process—conversion of sliver by drafting into a thinner strand called a roving in which a small amount of twist (normally 2 turns per inch) is imparted to the strand. This step is performed only in conjunction with subsequent ring spinning. No other type of spinning presently requires roving prior to spinning.

Ring-spinning process—As used herein, an operation for converting roving into yarn by drafting a roving and imparting twist through use of a ring and a moving traveler on a ring-spinned frame. A small percentage of ring-spinning machines do not require prior formation of roving, but instead convert sliver directly into yarn except that the sliver is passed through additional drafting apparatus on the ring frame immediately prior to passage through the ordinary draft rolls/aprons associated with ring spinning.

SUMMARY

A new system is provided for directly producing core/wrap yarn from a plurality of unwrapped rovings. Broadly, the invention comprises feeding a core strand and wrap strand on each side of the core strand from the nip of a pair of draft rollers directly to a stationary strand support immediately downstream from the nip. The wrap strands, which are spaced from the core strand at the nip, converge with the core strand in an open channel on the support means, and wrap around the core strand, so as to form core/wrap yarn.

The support means provides an outwardly, downwardly curved support surface for the core and wrap strands. The curved surface includes an open channel which extends along the outwardly, downwardly curved support surface. The convergence and wrapping of the strands takes place in the channel.

The wrapped yarn then is passed to an ordinary ring traveler and wind-up spindle of a ring-spinning assembly. In this manner, unwrapped roving is a converted to core/wrap yarn in a continuous process.

It is an object of the present invention to produce a new core/wrap yarn having the following advantages and distinctions over previous yarn products:

It is covered at least 90% compared to much lesser percentage of previous core/wrap products.

The core fibers are oriented along the length of the yarn and are positioned in the middle of the cross-section.

Due to unique interlacing of the cover fibers (effected by two strands of drafted rovings, one on each side of the core material), the yarn sheath does not strip from the core at all. Furthermore, the strip resistance is equally good in both directions along the yarn.

The staple-core/cotton-wrap yarn produced with a high tenacity staple fiber is significantly stronger than an equivalent 100% cotton yarn or an equivalent, regular intimate-blend yarn.

The device is capable of producing relatively fine yarns (e.g., yarns of up to 40/1 cotton count or finer).

Both the core as well as cover fibers contribute to the mechanical properties of the yarn produced by the present system; and mechanical properties, such as tear strength, tensile strength and abrasion resistance, of the fabrics produced from such yarns have exhibited significant improvements.

The staple-core-spun yarns of the present invention are economical compared to existing filament-core yarns, mainly because of the lower cost of the staple fibers, compared to filament yarns.

Inferior quality cotton, wool, manmade fibers, or any other fiber can be used in the core, and the premium fiber can be utilized in the cover to produce a premium-looking product.

Many types of novelty yarns and fabrics, such as crepe-like, denim-like, and differential dye effects, can be producing by the spinning technique of the present invention.

It is much easier to piece-up the ends during spinning, when compared to earlier reported spinning techniques.

The staple-core yarns are highly useful for producing textile products where high strength and cotton surface are both desirable and/or critical, such as strong, easy-to-care-for and comfortable apparel of predmoninantly cotton; certain military fabrics; such as tentage, chambray shirting, work uniforms, strong sewing threads with heat-insulation cotton cover, and strong pill-resistant fabrics.

Other objects and advantages of the present invention will be obvious from the following detailed description, in conjunction with the drawings in which.

Figure 2:
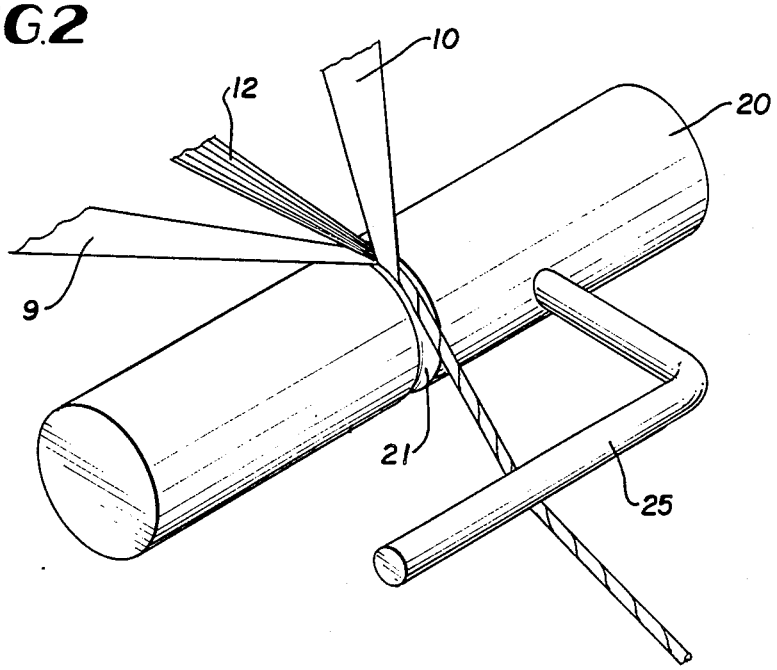
FIG. 2 is a partial perspective view of bar 20 of FIG. 1.
Figure 2A:
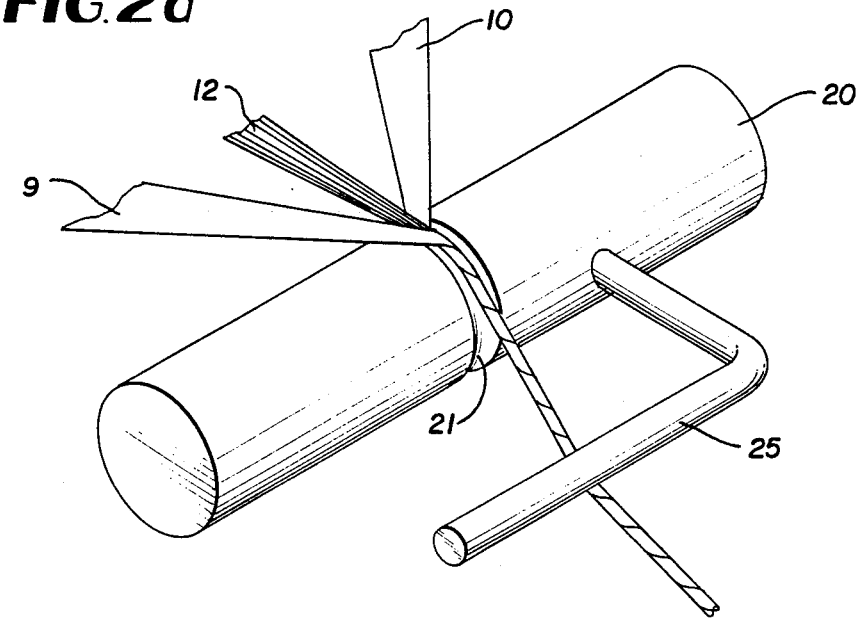

FIG. 2*a* is an alternative embodiment of FIG. 2.

Figure 1:
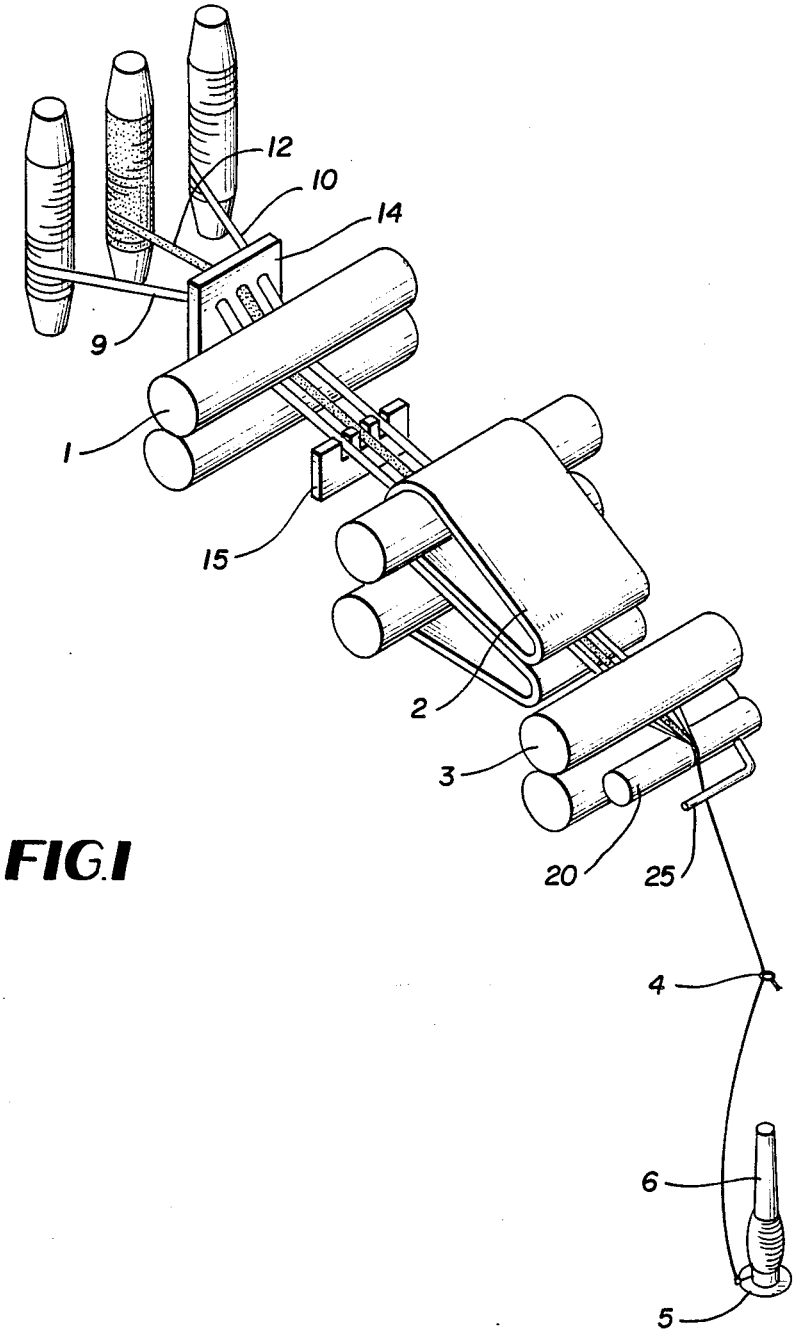
FIG. 1 is a perspective view of the overall system of the present invention.
Figure 3:
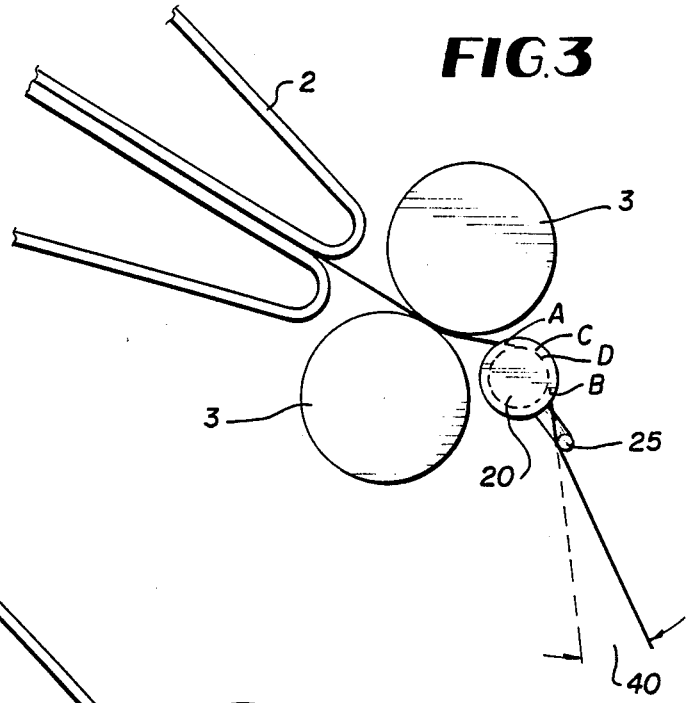

FIG. 3 is a side view of part of the apparatus of FIG. 1.

Figure 3A:
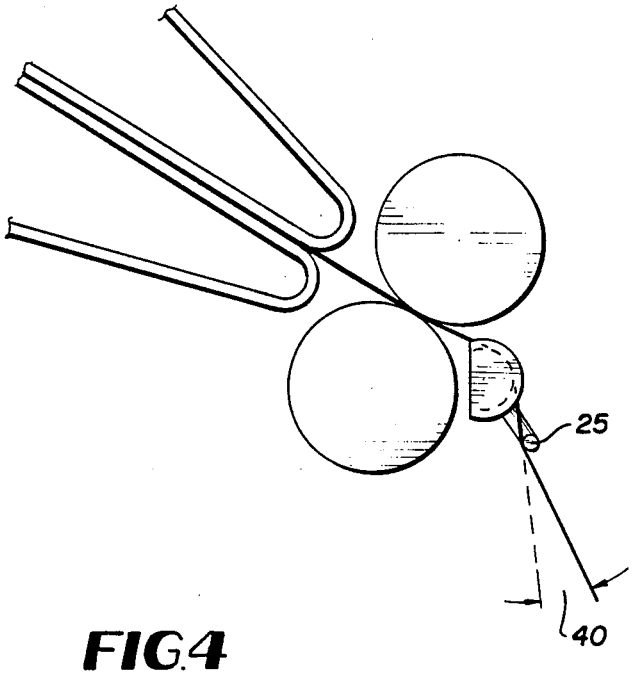

FIG. 3*a* is a side view of an alternative embodiment.

Figure 4:
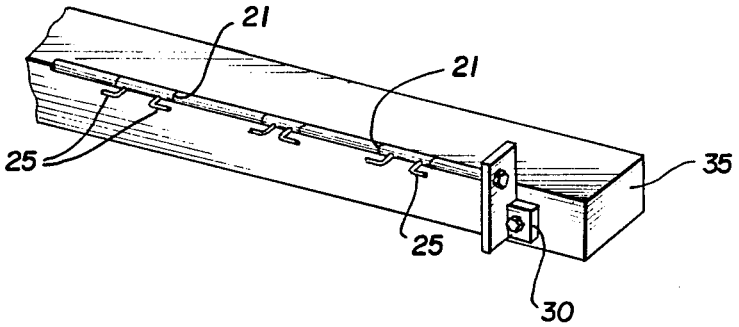

FIG. 4 generally shows the use of bar 20 in conjunction with a plurality of side-by-side spinning systems mounted on the same frame.

DETAILED DESCRIPTION

Components of ordinary ring spinning equipment may be employed in the practice of the present invention. These are illustrated in FIG. 1 as rear draft rollers 1, drafting aprons 2, front draft rollers 3, pigtail guide 4, ring 5 and yarn bobbin 6. Hereinafter, this combination of elements is referred to as a single spinning system.

In addition, there are three bobbins upstream of rear draft rollers 1. Two of these bobbins feed wrap roving 9 and 10 such as cotton roving to rear rollers 1, while the other bobbin feeds core roving 12 such as polyester roving thereto.

Starting materials for the practice of the present invention, such as cotton and polyester rovings, may be prepared in a conventional manner.

A conventional roving condenser 14 is disposed between the bobbins and rear rollers 1 in order to maintain a space between rovings. In addition, another condenser 15 is positioned between rollers 1 and aprons 2 so as to provide unconventional spacing between strands that emerge from the nip of front rollers 3. That is, this latter condenser is dimensioned to provide unequal spacing from the core strand to each wrap strand at the point of emergence of the strands from the nip of front rollers 3. In other words, the space between wrap strand 9 and core 12 is not the same as the space between wrap strand 10 and core 12 at the point of emergence of these strands from the nip of the front rollers 3. More specifically, the spacing between strands 9 and 12 is slightly less than the spacing between strands 10 and 12 in the case of a "Z" twist at yarn formation (FIG. 2), and vice-versa in the case of "S" twist (FIG. 2*a*). Generally, the lesser spacing is about 70–80% of the greater spacing between centerlines of respective strands.

Referring to the lesser spacing between wrap and core, this will depend upon the fiber length being processed, and consequently on the size of the spinning equipment (i.e., short-, mid-, or long-staple spinning system). For a conventional cotton (short-staple) spinning system, the lesser space between wrap and core strands may be about 3/32" to 5/32". For long staple fibers such as wool, this dimension may vary from about $\frac{1}{4}$" to $\frac{5}{8}$".

Referring again to FIG. 1, disposed between pigtail guide 4 and front rollers 3 is a cylindrically-shape, hollow or solid bar 20. The bar provides an outwardly, downwardly directed support surface for the core and wrap strands. The bar acts as a support for the strands and as the point at which wrapped yarn formation occurs.

As can be seen in FIGS. 2 or 2*a*, a groove 21 is present in bar 20 which constitutes the necessary open channel in the support surface through which the core strand passes, and in which the wrap strands envelop the core strand. Groove 21, which lies in a plane which is perpendicular to the plane of the front roller nip, is positioned such that core strand 12 passes directly from the nip into the groove, while wrap strands 9 and 10 first pass in contact with the surface of bar 20 adjacent groove 21 before entering the groove.

Bar 20 and the wall of groove 21 most preferably are polished at least where these elements directly contact the wrap and core strands.

The diameter of bar 20 depends upon fiber length, especially of the wrap fiber length. For a typical 1.5" long polyester-staple-core and 1" long cotton-wrap fibers, the diameter of the bar may be about $\frac{3}{8}$" to $\frac{3}{4}$". For a 3" long staple fiber, the bar may be as much as 2" in diameter.

The fibrous strands emerging from the roller nip are weak due to absence of twist. Only the inter-fiber cohesion and the support of bar 20 keep the materials intact and continuously flowing without breakage or interruption.

The distance between bar 20 and the front roller nip should be such that there is essentially no drafting of the core strand between these two points. Thus, the distance between the yarn wrapping zone on bar 20 and the front roller nip, measured along the core strand, is less than the length of most of the fibers in the core strand. By avoiding drafting, the full yarn tension is maintained in the core strand upstream of bar 20. The loss of this tension otherwise would allow excessive "twist" upstream of bar 20 and would result in barber-poling and less than subsequent full coverage of the core strand by the wrap strands.

In addition, the distance of bar 20 from the front roller nip should be such that there is no drafting of the longest fibers (i.e., for cotton, the so-called "2.5% span length" fibers) in the wrap strands, but there is drafting of some of the shorter fibers therein. In other words, the distance along each wrap strand from the point of emergence of each wrap strand at the front roller nip to the yarn formation point on bar 20 is greater than the shortest fiber length therein but about 50–80% of the "staple" length. In the case of cotton-wrap fibers, the distance along the wrap strands measured from front rollers nip to yarn formation typically is about $\frac{1}{2}$" to $\frac{7}{8}$".

Thus, in the practice of the present invention, the fibers, after emerging from the nip of the front rollers, are loose with no twist to hold them together except for the slight twist imparted to the core-strand-fibers during passage from nip to bar. The bar acts as a guide for transportation of fibers from the nip to the yarn formation point on the bar.

With further regard to positioning the bar, its longitudinal axis generally may be approximately equidistant from and parallel to the axes of the two front rollers, as shown in FIG. 3. The exact position should be set to provide the appropriate fiber path, as set forth above, from the nip of the front rolls to the point of contact with the bar, while still allowing clearance between the bar and each of the front rolls. The clearance between the bar and the nip front roll should be sufficiently large that even the thickest segments of drafted strands cannot be gripped between these surfaces, which would otherwise have the undersirable effect that the lateral movements of the wrapper fibers would be restricted and the flow of fibers would be interrupted. The clearance between the bar and the bottom front roll should be sufficiently large to that the bar does not interfere with the scavenging of fibers by the spinning system's vacuum system in case of yarn breakage. The use of a bar having a half-circle rather than full circle cross-sectional shape permits the bar to be positioned closer to the nip and bottom roll, as shown in FIG. 3*a*.

Taking the above factors into account, a typical spacing between the front roller nip and the closest surface of the bar is about ¼" to 7/16" in the case of cotton/-polyester wrap/core, and about 1" to 2" with regard to wool/polyester wrap/core.

Referring again to FIGS. 2 or 2*a*, groove 21 in bar 20 may be "v" shaped, rectangular, oval, circular, or any concave shape. Its width preferably should be slightly wider than the core strand diameter, i.e., about 1½ to 2 times the core strand diameter. The depth of the groove is about the same as the width, preferably about 75–150% of the groove width, depending upon groove shape. A flat (rectangular) groove may have a depth less than the width, while a "v" shaped groove may have a maximum depth greater than its maximum width.

Immediately after emergence from the front roller nip, the core and wrap strands tend to be flattened. However, the core strand tends to become cylindrical in cross-section as a result of being pulled into the groove 21 and as a result of some twist and tension being imparted thereto from downstream forces. These overall forces tend to condense and aggregate the core strand into a circular or oval cross-sectional shape.

As the strands emerge from the nip they are merged into a so-called sandwich in groove 21 with the core strand in the middle. One wrap roving lies below the core strand, and the other wrap roving lies about the core strand in the wrapping zone, as illustrated in the alternative embodiments of FIGS. 2 and 2*a*. The two wrap strands thereafter spirally wind around the core strand.

As shown in FIGS. 1–3, an "L" shaped yarn control guide 25, immediately downstream from and closely adjacent to bar 20, is screwed or otherwise attached to the bar. Guide 25 functions to prevent excessive yarn twist from flowing upstream past the guide.

In addition, guide 25 stabilizes the zone of contact between the fibers and bar 20. More specifically, as can be seen in FIGS. 1*a* or 1*b*, the initial points of contact between the core strand and each of the two wrap strands do not coincide with one another. The wrap strand which initially contacts the core on the underside of the core ordinarily is the first contact point between strands, which is designated as point C in FIG. 3, while the other wrap strand "overwraps" at a second downstream contact point D. The arc CD is the wrap zone. Prior to initial contact between any of the fibers, all three strands first should come into contact with the surface of bar 20 along a common line stream from point C, so that wrapping takes place on the bar 20, and not between the bar 20 and the front roller nip. This common line of contact, viewed on end as "A" in FIG. 3, is determined by the plane tangent to the upper roll of the front rollers 3 and the bar 20. Point B in FIG. 3 is the point of final contact of the wrapped yarn with the bar. This point is determined by the tangent from bar 20 to the surface of guide 25.

Arc AB in FIG. 3 defines the zone of direct contact between the fibrous strands and the bar. In operation, the wrapping zone CD should be stable and finite, and within AB, despite normal fluctuations in the overall nature of the contact between the fibrous strands and bar 20 during the dynamics of the spinning operation. Otherwise, there will be less than maximum coverage of the core strand by the wrap strands. In this context, about 30°–90° of arc measured along the core strand should remain in contact with bar 20 during operation.

Some factors which are taken into consideration in the postioning of guide 25 are as follows: As the pigtail guide 4 moves up and down with the ring rail 5 during winding of the product yarn, a positive deflection angle (FIG. 3 reference numeral 40) of the yarn from bar 20 around guide 25 to pigtail guide 4 (not shown in FIG. 3) should be maintained at all times. This deflection, however, should be as little as possible so as to avoid "trapping" too much twist, i.e., to avoid the situation where not enough twist flows upstream to maintain the integrity of the yarn or to perform the wrapping operation within the arc AB. This can be achieved by setting guide 25 so that it slightly deflects the path of the yarn from bar 20 to pigtail guide 4 when the pigtail and ring rail are at their lowest point in the package-building motion. For a typical cotton spinning frame, a minimum deflecton angle of about 10° to 15° is sufficient. The maximum deflection angle will occur when the pigtail guide and ring rail are at the maximum upward position, and typically will be about 9° greater than the initial (minimum) setting.

A simple way to provide for positioning of guide 25 is to fixedly secure it to bar 20 as by means of screws, and to mount the ends of bar 20 on the spinning frame in such a manner as to provide for rotational adjustment of the bar about its own axis (i.e., the bar is screwed at its axis to a bracket which in turn is fixed to the frame of the spinning system). In this arrangement, whenever the position of the bar is changed by loosening its axial screws and rotating the bar, guide 25 likewise is repositioned in a clockwise or counterclockwise direction around the bar.

During the spinning operation, if too much twist begins to flow back upstream so that, for instance, wrap zone CD migrates upstream of line A resulting in a barber-pole yarn, then the guide 25 can be repositioned (clockwise around bar 20 in FIG. 3) to increase the minimum deflection angle and thereby increase frictional drag, trap more twist, and re-adjust the position of the wrap zone back within arc AB on bar 20. This adjustment can be performed conveniently during the spinning operation, if the guide 25 is attached to the bar 20 as described above, by rotating the bar slightly while observing the wrap zone CD, so as to cause CD to center well within arc AB.

It also is desirable to minimize the change in deflection as the pigtail guide moves. Thus, guide 25 should be as close to bar 20 as possible to minimize this variation. On the other hand, there should be sufficient clearance to permit easy piecing up. Generally, a distance of about ½" to ¾", between guide 25 and bar 20 will be sufficient for both these purposes. In an alternative embodiment, guide 25 may be spring-loaded against the surface of bar 20 so as to lightly grip the yarn passing between bar and guide.

In the preferred practice of the present invention, one continuous bar may accomodate several side-by-side spinning systems, as illustrated in FIG. 4, so that there is a single open channel or groove 21 adjacent each front roller pair in each of the spinning systems. The ends of the bar may be screwed into brackets 30 at the axis of the bar, which brackets in turn are secured to the overall frame 35 of the spinning systems.

With regard to the operational speeds of the system of the present invention, spindle speed may be the same as that employed to spin yarn of a given linear density and twist multiple, in the ordinary manner, from a roving having the same overall blend composition and combined linear density as the three rovings (two wrapper plus core). In this case, the same twist gear and draft gear ratio would be used, and the same linear density yarn produced. The three rovings creeled per position in the present invention would each have to be prepared with linear densities, on the average, ⅓ of the linear density of the conventional roving.

Alternatively, a separate approach would be to use three rovings, each having the same linear density as the comparable conventional single roving. In this case, however, the draft gear would be selected to increase the draft by a factor of three because three times as much roving (three rovings versus one roving) is pieced into the drafting zone. The same twist gear and spindle speed would produce the same yarn linear density and twist multiple as in the conventional single-roving case.

A third approach combines a change in linear density of the rovings with a change draft gearing. One combination would be to reduce the roving linear densities by a factor of two, and increase the draft by a factor of 1.5. For instance, if a 1-hank roving is normally used with a draft of 28 to produce Ne 28 yarn in the conventional way, then three 2-hank rovings (one core and two wrapper rovings of different composition) may be used with a draft of 42 to produce Ne 28 core/wrap yarn by the present invention. Once again, the spindle speed and twist gear ratio of the machine would be the same, as would the resultant twist multiple of the yarn produced.

It will be obvious to those skilled in the art that many other practical combinations as to operational parameters exist. Variations in twist multiple, production rate, and yarn count may be accomplished by purely conventional manipulation of the textile relationships between the variables of roving linear density, spindle speed, twist and draft gearing, traveler weight, and so forth. In addition, basic ring spinning rules are to be considered. For instance, in cotton ring spinning, it is generally desirable to keep the draft below 50, and the roving count below three hank.

The following are general spinning parameters for a 28-tex, 67% cotton/33% polyester-staple-corn yarn produced by the system of the present invention:

| | |
|---|---|
| polyester roving (1) | = 2-hank (1.5"; 1.2 denier; and 6 g/denier |
| cotton rovings (2) | = 2-hank (1 1/16" staple; Acala) each; |
| combined hank of roving | = 0.67 |
| total draft | = 42 |
| spindle speed (rpm) | = 9,100 |
| twist multiple | = 4.00 |
| traveller | = #6 (1.6 grains) |
| relative humidity | = 51 |
| temperature (C.) | = 20 |

The present invention may be employed to wrap fibrous materials around continuous filament core material such as continous filament polyester, as well as around staple core material. When such continuous filament material is employed as the core strand, instead of being introduced into the drafting system through the back rolls, the filament core is fed into the drafting system immediately behind the front rollers and in alignment with groove 21 in bar 20. The operational speeds of the drafting zone and spindle speed are the same as for a similar system employing staple core material of the same linear density. The resulting product made from continuous polyester filament core strand and cotton wrap quite surprisingly has the same excellent strip resistance as a core/wrap yarn having a staple core strand.

We claim:

1. A ring-spinning system for forming core/wrap yarn comprising a. a drafting frame including front draft rollers having a nip therebetween;

b. a wind-up spindle assembly;

c. stationary support means immediately downstream from said nip, said support means having an outwardly, downwardly curved support surface, said surface having an open channel therein extending along said outwardly, downwardly curved surface;

d. means to feed a core strand and at least one wrap strand on each side of said core strand from said nip onto said support means, wherein said wrap strands are spaced from said core roving at said nip and converge with said core strand in said open channel to wrap around said core strand in said open channel so as to form wrapped yarn; and e. means to guide said wrapped yarn to said wind-up spindle assembly.

2. The apparatus of claim 1 where said wrapped yarn guide means comprises a first guide immediately downstream from and closely adjacent to said support means; wherein said wrapped yarn passes beneath said first guide.

3. The apparatus of claim 2 further including a condenser upstream from said draft rollers to separately feed said core strand and wrap strands to said draft rollers so that the distance between one of said wrap strands and said core strand is greater than the distance between the other of said wrap strands and said core strand.

4. The apparatus of claim 2 wherein said support means is a cylindrically-shaped bar.

5. The apparatus of claim 2 further including means to adjust the position of said first guide, said adjusting means comprising (a) means to fix said first guide to said support means, and (b) means to rotationally adjust said support means along the axis of said support means that is parallel to said draft rollers.

6. The apparatus of claim 2 comprising a plurality of side-by-side spinning systems; wherein said support means is downstream from the front draft rollers of each of said systems; and wherein there are a plurality of open channels in said support means, each channel receiving a core strand and wrap strands from a single spinning system.

7. The apparatus of claim 6 wherein said support means comprises a cylindrically-shaped bar.

8. The apparatus of claim 7 further including a condenser upstream from each pair of said front draft rollers to separately feed said core strand and wrap rovings to said draft rollers so that the distance between one of said wrap strands and said core strand is greater than the distance between the other of said wrap strands and said core strand.

9. The apparatus of claim 8 further including means to adjust the position of said first guide, said adjusting means comprising (a) means to fix said first guide to said support means, and (b) means to rotationally adjust said support means along the axis of said support means that is parallel to said draft rollers.

10. A method of forming core/wrap yarn on a ring-spinning system that includes a wind-up spindle assembly and a drafting frame having a pair of front rollers defining a nip therebetween comprising a. passing a core strand and wrap strands on each side of said core strand from said nip of a pair of rollers to a stationary support surface that is outwardly, downwardly curved, and which includes an open channel therein which is outwardly, downwardly curved along said surface, wherein said wrap strands are spaced from said core strand at said nip;

b. passing said core strand through said channel;

c. passing said wrap strands to said channel to converge upon and wrap around said core strand in said channel to form wrapped yarn in said channel; and d. passing said wrapped yarn from said channel to said wind-up spindle assembly.

11. The method of claim 10 wherein the step of passing said wrapped yarn from said channel to said spindle comprises passing said wrapped yarn beneath a guide immediately downstream from and closely adjacent to said channel.

12. The method of claim 11 further comprising passing said wrapped yarn from said guide directly to a pigtail guide on said wind-up spindle.

13. The method of claim 11 further comprising maintaining the spacing between said core strand and wrap strands at said nip so that the distance between one of said wrap strands and said core strand is greater than the distance between the other of said wrap strands and said core strand.

14. The method of claim 13 wherein said core strand is drafted from a roving of different composition than said wrap strands.

15. The method of claim 11 comprising a plurality of side-by-side spinning systems; wherein said support surface is downstream from the front draft rollers of each of said systems; and wherein there are a plurality of open channels in said support surface, each channel receiving core strand and wrap strands from a single spinning system.

16. The method of claim 11 wherein said core strand is drafted from a roving of different composition than said wrap strands.

17. The method of claim 10 wherein said core strand is drafted from a roving of different composition than said wrap strands.

18. A method of forming core/wrap yarn on a ring-spinning system that includes a wind-up spindle assembly and a drafting frame having a pair of front rollers comprising a. passing a continuous filament core and wrap strands on each side of said core from the nip of said pair of front rollers of said ring-spinning system to a stationary support surface that is outwardly, downwardly curved, and which includes an open channel therein which is outwardly, downwardly curved along said surface, wherein said wrap strands are spaced from said core strand at said nip; wherein said core is of a different composition than said wrap strands;

b. passing said core through said channel;

c. passing said wrap strands to said channel to converge upon and wrap around said core in said channel to form wrapped yarn in said channel;

d. passing said wrapped yarn beneath a guide immediately downstream from and closelly adjacent to said channel; and e. thereafter passing said wrapped yarn to said wind-up spindle assembly.

19. The method of claim 18 wherein said core is continuous filament polyester.

20. The method of claim 19 wherein said wrap strands are cotton.

* * * * *